US011548771B2

(12) United States Patent
Nishide et al.

(10) Patent No.: US 11,548,771 B2
(45) Date of Patent: Jan. 10, 2023

(54) CHUCK FOR CAPPING MACHINE

(71) Applicant: SHIBUYA CORPORATION, Kanazawa (JP)

(72) Inventors: Yasuto Nishide, Kanazawa (JP); Hiroyoshi Yamada, Kanazawa (JP)

(73) Assignee: SHIBUYA CORPORATION, Kanazawa (JP)

( * ) Notice: Subject to any disclaimer, the term of this patent is extended or adjusted under 35 U.S.C. 154(b) by 0 days.

(21) Appl. No.: 17/500,945

(22) Filed: Oct. 14, 2021

(65) Prior Publication Data

US 2022/0112064 A1 Apr. 14, 2022

(30) Foreign Application Priority Data

Oct. 14, 2020 (JP) ..... JP2020-173418

(51) Int. Cl.
*B67B 3/20* (2006.01)

(52) U.S. Cl.
CPC ..... *B67B 3/2066* (2013.01); *B67B 3/2033* (2013.01)

(58) Field of Classification Search
CPC ..... B67B 3/2066
See application file for complete search history.

(56) References Cited

U.S. PATENT DOCUMENTS

2004/0237471 A1* 12/2004 Hidding ..... B67B 3/2033 53/334
2006/0150580 A1* 7/2006 Joerg ..... B67B 3/2066 53/317
2014/0123597 A1* 5/2014 Mallett ..... B67B 3/2066 53/317

FOREIGN PATENT DOCUMENTS

JP 4175290 B2 11/2005
JP 6350061 B2 2/2016

* cited by examiner

*Primary Examiner* — Andrew M Tecco
*Assistant Examiner* — Jacob A Smith
(74) *Attorney, Agent, or Firm* — Mori & Ward, LLP

(57) ABSTRACT

A chuck for a capping machine includes a plurality of chuck members, a biasing member configured to bias the plurality of chuck members radially inward, an abutting portion configured to abut against a top face of a cap, and a plurality of chuck jaws provided on an inner surface of each of the plurality of chuck members to engage knurls of the cap. Each of the plurality of chuck jaws includes a leading flank and a trailing flank. An angle of the trailing flank with respect to an outer circumference of the cap is less than an angle of the leading flank with respect to the outer circumference of the cap.

1 Claim, 9 Drawing Sheets

CHUCK FOR CAPPING MACHINE

CROSS-REFERENCE TO RELATED APPLICATIONS

The present application claims priority under 35 U.S.C. § 119 to Japanese Patent Application No. 2020-173418, filed Oct. 14, 2020. The contents of this application are incorporated herein by reference in its entirety.

BACKGROUND OF THE INVENTION

1. Field of the Invention

The present invention relates to a chuck for a capping machine.

2. Description of the Related Art

A capping machine, which screws a cap onto a mouth of a vessel, lowers a plurality of chuck members that grip the outer circumference of the cap while rotating, so that a female screw provided on the inner circumference of the cap is screwed onto a male threaded surface formed on the outer circumference of the mouth of the vessel. Knurls or serrations are provided on the outer circumference of the cap along its generating lines while chuck jaws that are engageable with the knurls on the outer circumference of the cap are provided on the inner surface of each chuck member. The plurality of chuck members is biased radially inward by a spring arranged along the outer circumference of the plurality of chuck members so that the chuck jaws of each chuck member are pressed against the outer circumference of the cap. See Japanese Patent Publication No. 6350061 and Japanese Patent Publication No. 4175290.

SUMMARY OF THE INVENTION

According to one aspect of the present invention, a chuck for a capping machine includes a plurality of chuck members, a biasing member configured to bias the plurality of chuck members radially inward, an abutting portion configured to abut against a top face of a cap, and a plurality of chuck jaws provided on an inner surface of each of the plurality of chuck members to engage knurls of the cap. Each of the plurality of chuck jaws includes a leading flank and a trailing flank. An angle of the trailing flank with respect to an outer circumference of the cap is less than an angle of the leading flank with respect to the outer circumference of the cap.

BRIEF DESCRIPTION OF THE DRAWINGS

The objects and advantages of the present invention will be better understood from the following description with references to the accompanying drawings in which.

DESCRIPTION OF THE PREFERRED EMBODIMENTS

Figure 1:
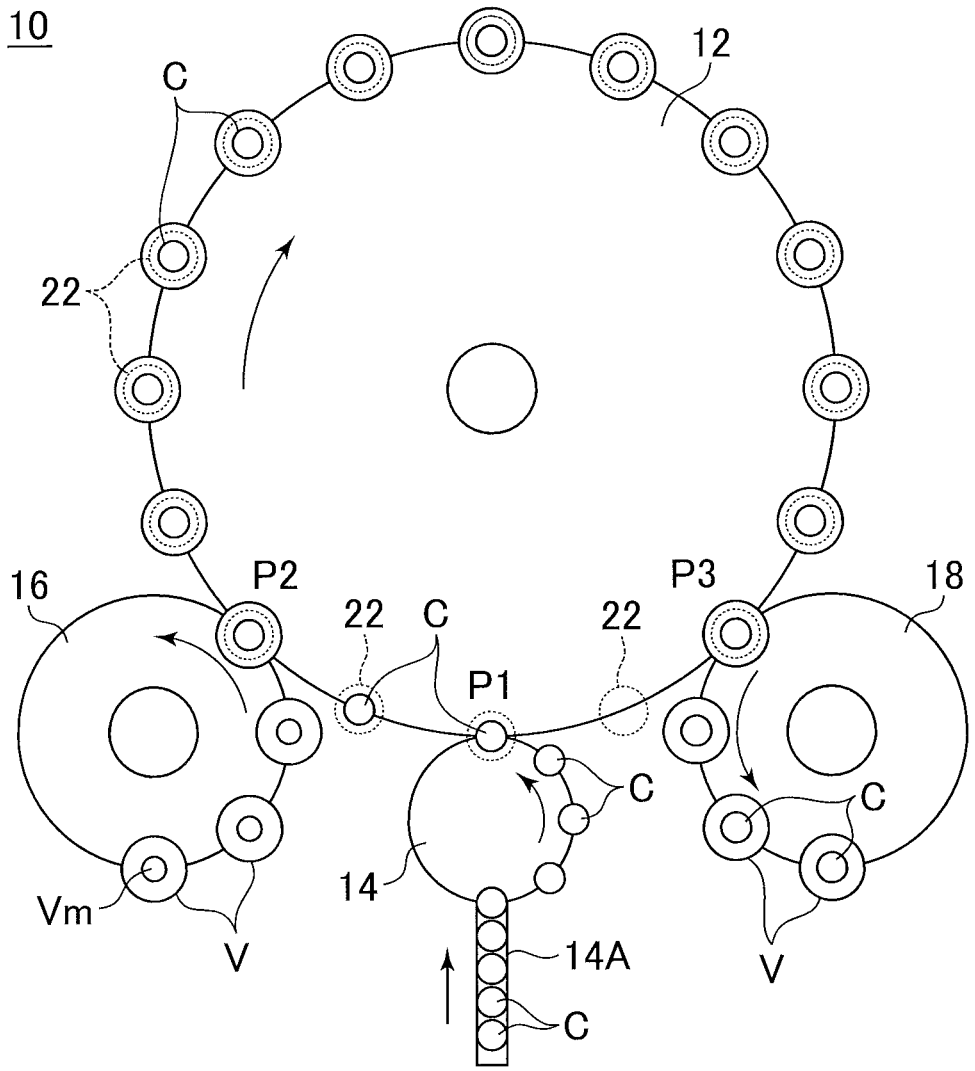
FIG. 1 is a plan view schematically illustrating an arrangement of a capping machine of the first embodiment.
Figure 2:
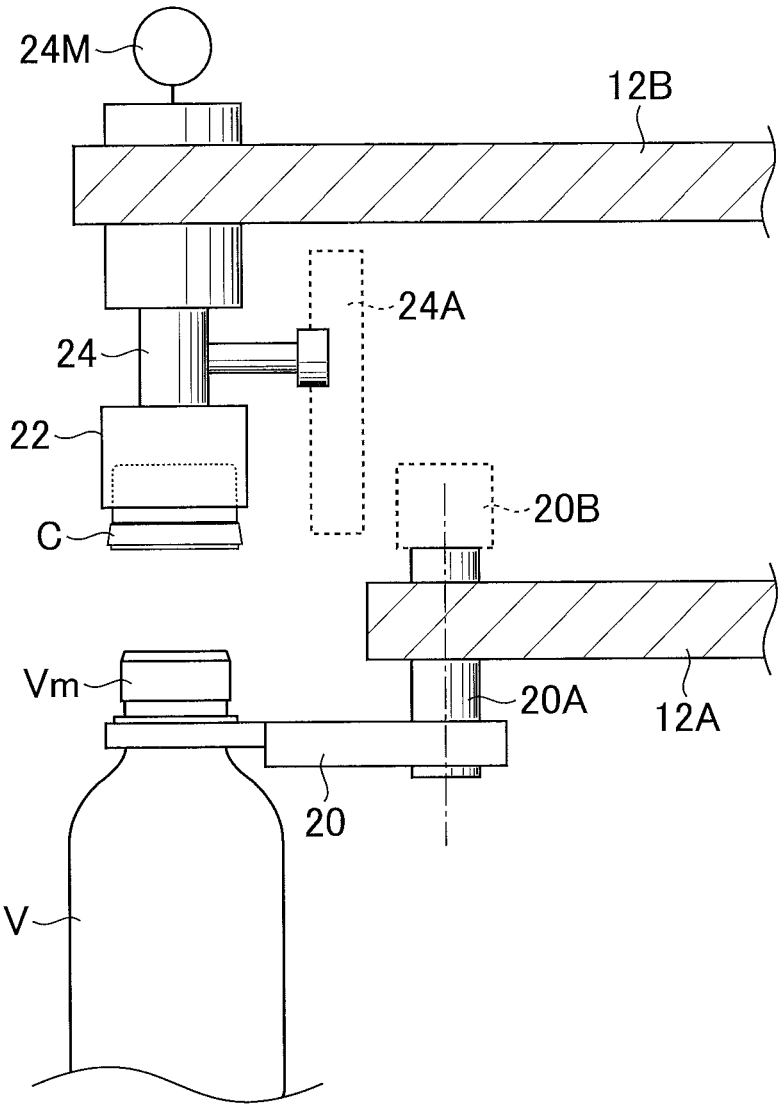
FIG. 2 is a partial side-sectional view of the capping machine around its circumference.

The present invention is described below with references to the embodiments shown in the drawings. FIG. 1 is a plan view schematically illustrating an arrangement of a capping machine of the first embodiment. FIG. 2 is a partial side-sectional view of the capping machine around its circumference.

The capping machine 10 of the present embodiment screws a cap C onto the mouth of a vessel V. Capping is performed on a capping wheel 12. A cap supply disk 14 is arranged adjacent to a cap-receiving position P1 of the capping wheel 12. Caps "C" are supplied to the capping wheel 12 via the cap supply disk 14. The cap "C" is provided with a female screw on its inner circumference and with knurls or serrations at a predetermined interval along generating lines on its outer circumference. The caps "C" are supplied form a cap chute to the cap supply disk 14.

An inlet star-wheel 16 is disposed adjacent to a vessel-receiving position P2 of the capping wheel 12, which is a position downstream from the cap-receiving position P1. Vessels "V" with a threaded surface provided on the outer surface of their mouths are supplied from the inlet star-wheel 16 to the capping wheel 12. The capping wheel 12 screws the cap "C" onto the mouth "Vm" of the vessel "V", while the cap "C" and the vessel "V" are being transferred along the outer periphery of the capping wheel 12, and thus the capping operation is carried out on the capping wheel 12. The vessels "V", which are capped by the capping wheel 12, are delivered to an outlet star-wheel 18 at a vessel discharge position P3 disposed downstream of the vessel-receiving position P2 and upstream of the cap-receiving position P1. The capping wheel 12, cap supply disk 14, inlet star-wheel 16 and outlet star-wheel 18 are synchronously rotated by a controller.

In the present embodiment, vessels "V" are held at their neck portions by neck grippers 20 that are provided at a regular interval along the outer periphery of a lower rotating body 12A of the capping wheel 12, as illustrated in FIG. 2. Each neck gripper 20 is opened and closed by a conventional gripper opening-and-closing mechanism 20B, which uses a cam mechanism or an actuator, via a pair of gripper pivot axes 20A.

Chucks 22 for holding the cap "C" are arranged above each of the vessels "V", which are held by the neck grippers 20. Each chuck 22 is provided at the bottom of a spindle (a rotational axis) 24. The spindles 24 are provided along the outer periphery of an upper rotating body 12B at a regular interval corresponding to each of the neck grippers 20. The spindles 24 are rotatably and liftably supported by the upper rotating body 12B. The top end of each spindle 24 is connected to a servo motor 24M for rotating the chuck 22 and is also configured to be liftable by a conventional lift mechanism 24A, such as one using a cam mechanism and the like. The lower rotating body 12A and the upper rotating body 12B are integrally rotated as the capping wheel 12.

Figure 3:
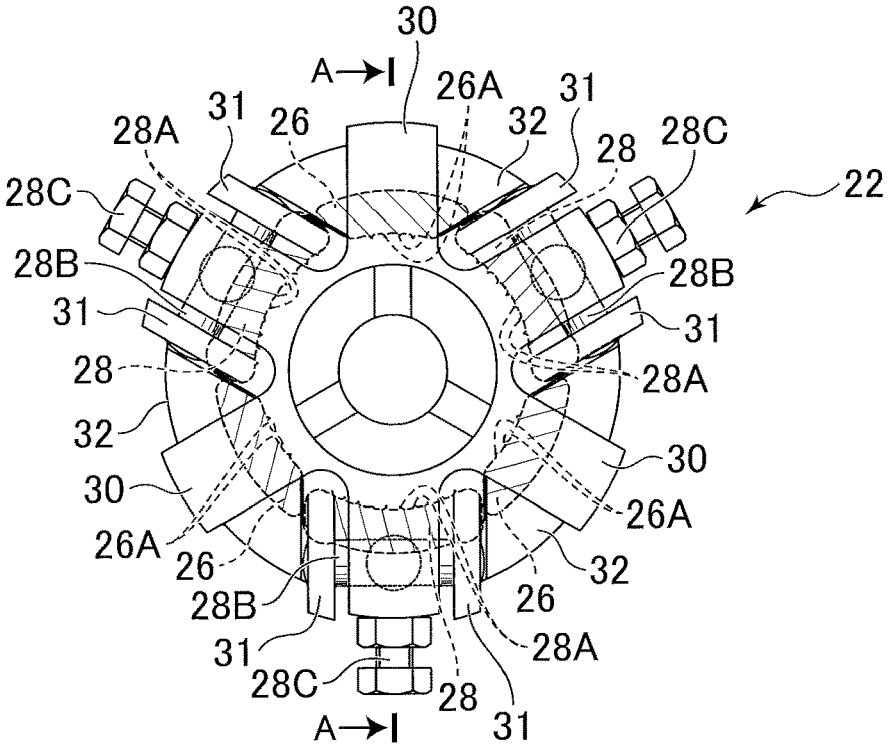
FIG. 3 is a top plan view illustrating an internal configuration of the chuck of the first embodiment.
Figure 4:
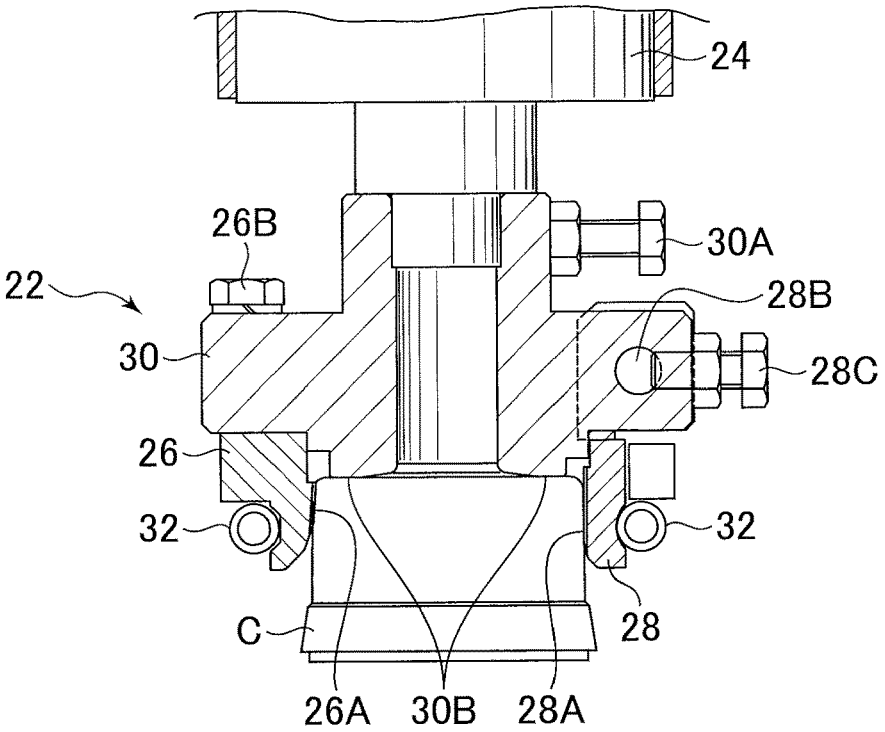
FIG. 4 is a cross sectional view of the chuck along Line A-A of FIG. 3.
Figure 5:
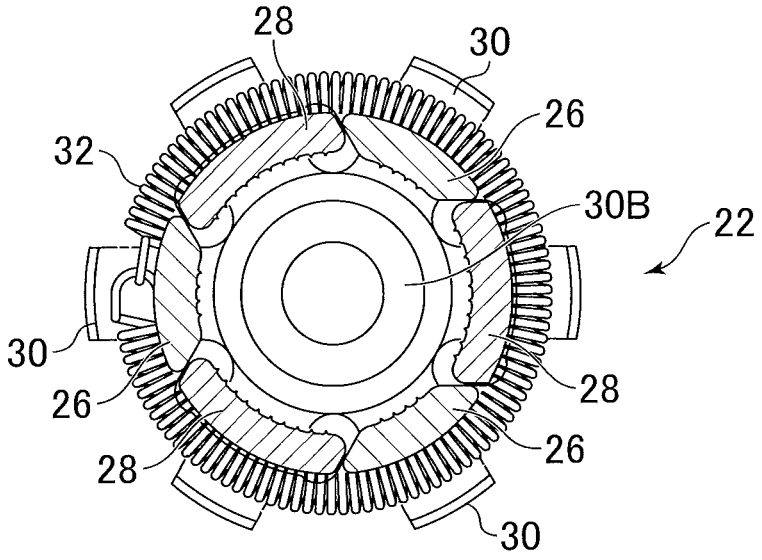
FIG. 5 is a bottom plan view illustrating an internal configuration of the chuck of the first embodiment.

FIG. 3 is a top plan view illustrating an internal configuration of the chuck 22 and FIG. 4 is a cross-sectional view along Line A-A of FIG. 3. Furthermore, FIG. 5 is a bottom plan view illustrating an internal configuration of the chuck 22.

The chuck 22 of the present embodiment includes three fixed members 26 and three chuck members 28. The fixed members 26 and the chuck members 28 are circumferentially arranged alternately. As described later, fixed chuck jaws or serrations 26A, which engage with the knurls on the outer circumference of the cap "C", are provided on the inner surface of the fixed members 26. Furthermore, movable chuck jaws 28A, which are engage-able with the knurls on the outer circumference of the cap "C", are provided on the inner surface of the chuck members 28.

The fixed members 26 and the chuck members 28 are arranged beneath a base member 30 circumferentially. The fixed members 26 are attached fixedly to the base member 30 by bolts 26B while the chuck members 28 are pivotally attached to the base member 30 through horizontal pivot shafts 28B. Each pivot shaft 28B is supported via a pair of shaft supports 31. Furthermore, the pivot range of the chuck members 28 is adjustable by an adjustment bolt 28C attached to the base member 30. The base member 30 is attached to the bottom end of the spindle 24 using a bolt 30A.

A biasing member 32, such as a coil spring, is arranged around the outer circumference of the fixed members 26 and the chuck members 28, so that the pivotally supported chuck members 28 are biased inward. Thereby, when the spindle 24 is lowered to the cap-receiving position P1 and the cap "C" is inserted inside the chuck 22 from below, the chuck members 28 are expanded radially outward against the biasing force of the biasing member 32 so that the movable chuck jaws 28A securely engage with the circumference of the cap "C". Furthermore, the top face of the cap "C", which is inserted inside the chuck 22, abuts against an abutting portion 30B provided at the center of the lower end of the base member 30.

Figure 6:
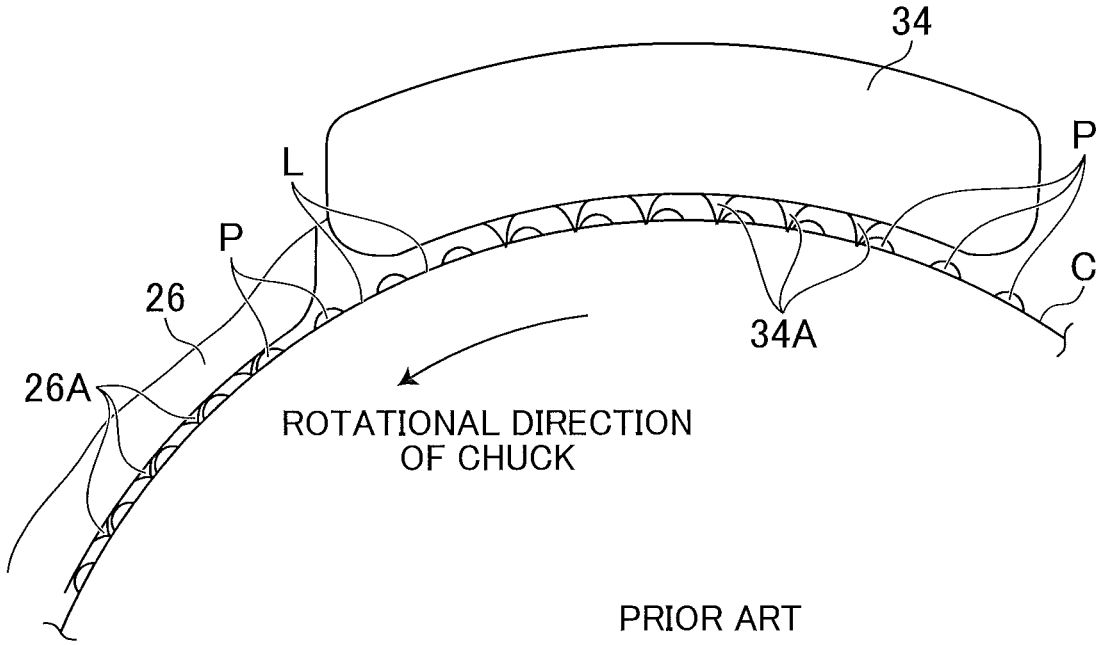
FIG. 6 is an enlarged bottom plan view of the movable chuck jaws of a prior art.
Figure 7:
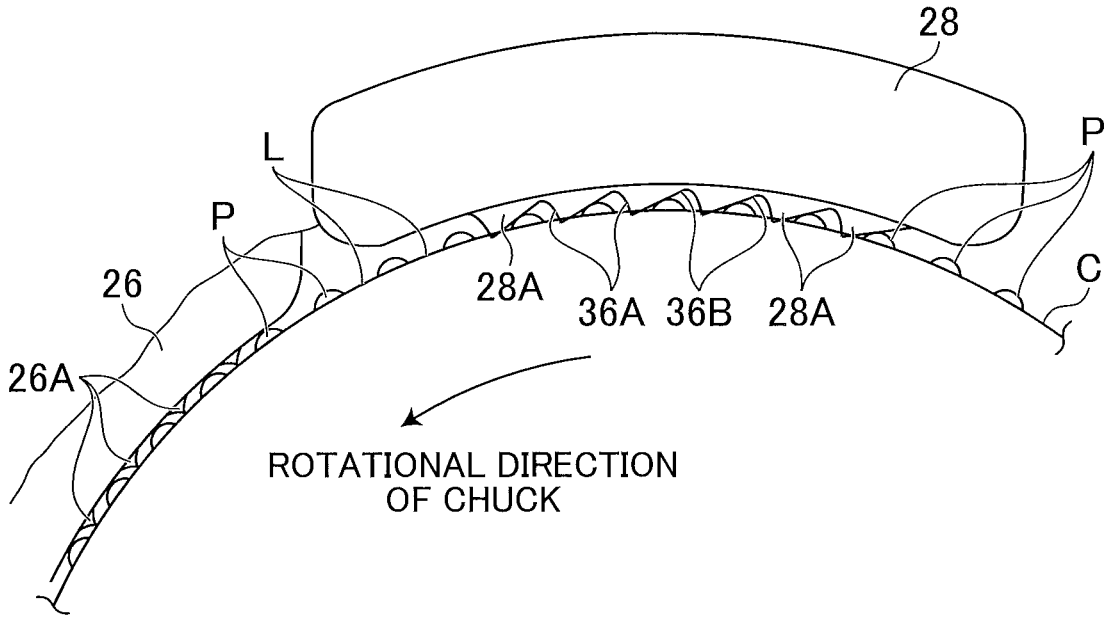
PRIOR ART FIG. 7
FIG. 7 is an enlarged bottom plan view of the movable chuck jaws of the first embodiment.
Figure 8:
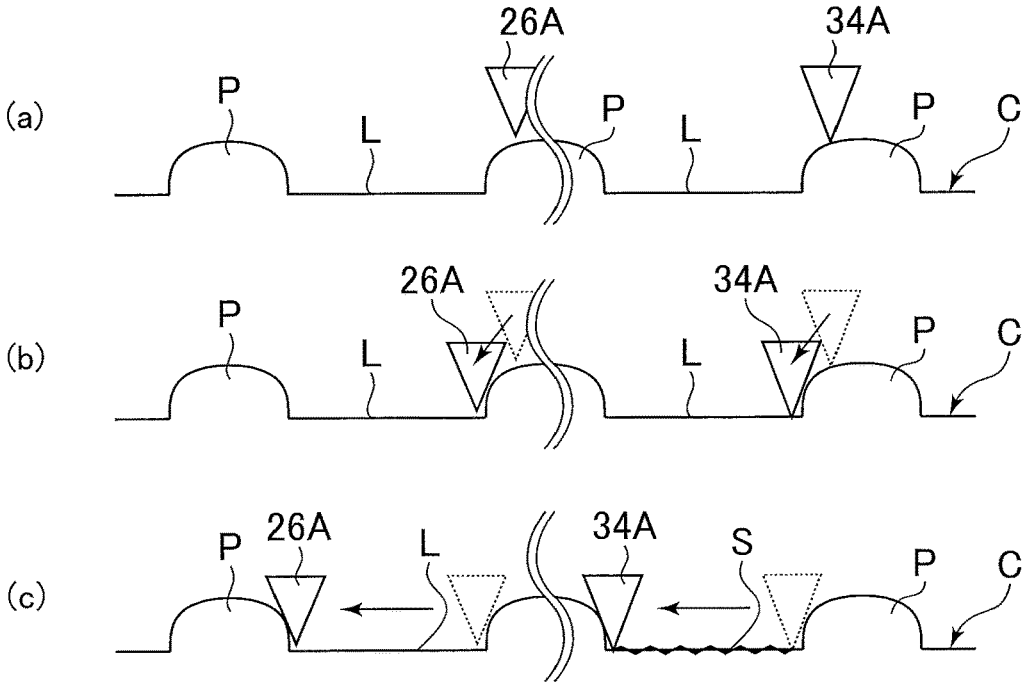
FIG. 8 schematically illustrates states of the movable chuck jaws and fixed chuck jaws of the prior art in time series.
Figure 9:
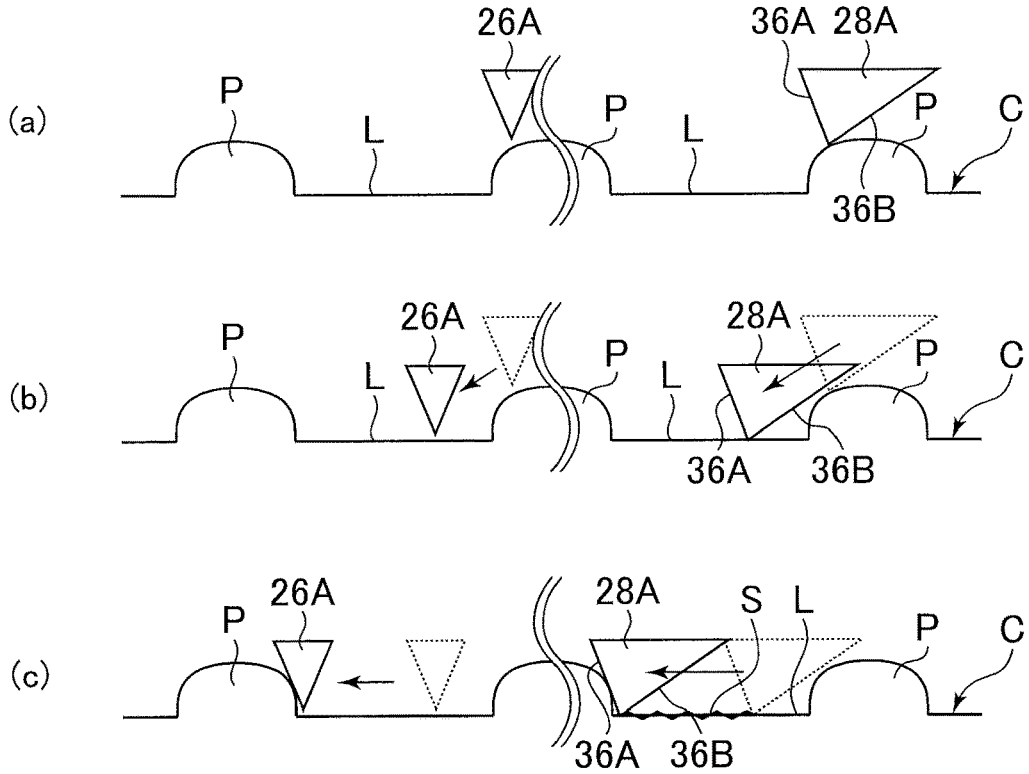
PRIOR ART FIG. 9
FIG. 9 schematically illustrates states of the movable chuck jaws and fixed chuck jaws of the first present embodiment in time series.

Next, with reference to FIGS. 6-9, the configurations and effect of the movable chuck jaws 28A are explained. FIGS. 6 and 7 are enlarged bottom plan views of movable chuck jaws 34A from a prior art and the movable chuck jaws 28A of the present embodiment, while FIGS. 8 and 9 schematically illustrate states of the movable chuck jaws 34A, 36A and fixed chuck jaws 26A of the prior art and the present embodiment in time series, which are viewed from the bottom, when the chucks are rotated to screw the cap "C" onto the vessel "V". Note that the side walls of the caps "C" are linearly developed in FIGS. 8 and 9 for illustration purposes.

The movable chuck jaws 34A of the prior art shown in FIG. 6 are formed symmetrically. On the other hand, the movable chuck jaws 28A of the chuck member 28 of the present embodiment are asymmetrical as shown in FIG. 7. Namely, the movable chuck jaw 34A includes a leading flank 36A, which is on the front side in a chuck-rotating direction, and via the crest of the knurl "P", a trailing flank 36B, which is on the rear side in the chuck-rotating direction. The leading flank angle with respect to a tangent line of the outer circumference of the cap "C" is greater than the trailing flank angle with respect to a tangent line of the outer circumference of the cap Incidentally, the configurations of the fixed chuck jaw 26A and the fixed member 26 are the same as the prior art, such that the fixed chuck jaw 26A is symmetrical.

As illustrated in FIGS. 6 and 7, the fixed member 26 is located at a position where each of the fixed chuck jaws 26A are disposed between the knurls "P" of the cap "C". However, the fixed members 26 are fixed at the positions where the tips of the fixed chuck jaws 26A do not make contact with the outer circumference of the cap "C", which corresponds to arcuate land portions "L" between the knurls "P". On the other hand, the chuck members 28 and 34 are pivoted radially inward via the biasing member 32 and are located at positions where the tips of the movable chuck jaws 28A and 34A stick into the land portions "L" of the cap "C". Namely, when the chuck 22 engages with the cap "C" as the chuck 22 is lowered to receive a cap "C" from the cap supply disk 14, the chuck members 28 are expanded outward against the biasing force of the biasing member 28 and the cap "C" is fitted into the chuck 22 and the tips of the movable chuck jaws 28A and 34A stick into the land portions "L". Moreover, the chuck members 28 function to hold the cap "C" while the fixed members 26 do not contribute to holding the cap "C". The fixed chuck jaws 26A of the fixed members 26 only function in transmitting screwing torque generated by the servo motor 24M to the knurl "P".

FIG. 8 illustrates states of the fixed chuck jaws 26A and the movable chuck jaws 34A of the prior art in a time series when contact is made with the knurls "P" of the cap "C" when the cap "C" is screwed on the mouth "Vm" of the vessel "V" as the chuck is rotated.

The outer surface of the cap "C", which is provided with knurls "P" along its generating lines, has a form that slightly expands radially as it goes downward (toward the opening), i.e., the cap "C" is substantially formed in a truncated cone shape. The chuck is lowered while rotating and the tips of the movable chuck jaws 34A make contact with the top faces of the knurls "P" when the cap "C" is inserted inside the chuck, as illustrated in FIG. 8 (*a*). At this time, the fixed chuck jaws 26A do not make contact with the top faces of the knurls "P" and instead remain a short distance apart. As the rotating chuck is lowered, the tips of the movable chuck jaws 34A make contact with the land portions "L" with the trailing flanks of the movable chuck jaws 34A in contact with the knurls "P", as illustrated in FIG. 8 (*b*). Simultaneously, the trailing flanks of the movable chuck jaws 34A move in contact with the knurls "P" but the tips of the fixed chuck jaws 26A do not make contact with the land portions "L" and instead remain a short distance apart. Note that the movable chuck jaws 34A immediately engage with the land portions "L" without engaging with the knurls "P" when the cap "C" is inserted into the chuck 22 with the tips of the fixed chuck jaws 26A and the movable chuck jaws 34A each located at positions corresponding to the land portions "L" (between two knurls "P"), which may occur in certain conditions affecting the positions of the cap "C" on the cap supply disk 14 and the chuck 22.

The tips of the movable chuck jaws 34A, which are engaged with the land portions "L" of the cap "C", slightly stick into the land portion "L", and as the chuck 22 rotates, the fixed chuck jaws 26A and the movable chuck jaws 34A move along the land portions "L" until their leading flanks abut the knurls of the cap "C", as illustrated in FIG. 8(*c*). During this process, scratch marks "S" are created on the land portions "L" of the cap "C" along the loci of the movable chuck jaws 34A.

FIG. 9 correspond to FIG. 8 when the symmetrical movable chuck jaws 34A of the prior art are replaced by the movable chuck jaws 28A of the present embodiment. As illustrated in FIG. 9, even when the movable chuck jaws 28A of the present embodiment are applied, scratch marks "S" are created on the land portions "L" of the cap "C" along the loci of the movable chuck jaws 28A, until the leading flanks of the movable chuck jaws abut the knurls of the cap "C". However, because the angle of the trailing flank 28A of the present embodiment with respect to the land portion "L" is smaller than that of the trailing flank 36A, i.e., the length of the trailing flank 38B is longer than the leading flank 36A, the position in which the tip of the movable chuck jaw 28A engages with the land portion "L" is relatively distant from the knurl "P" with respect to the prior art so that the length of the scratch marks "S" is reduced.

As discussed above, according to the first embodiment, the scratch marks on the land portions of the cap are reduced.

Figure 10:
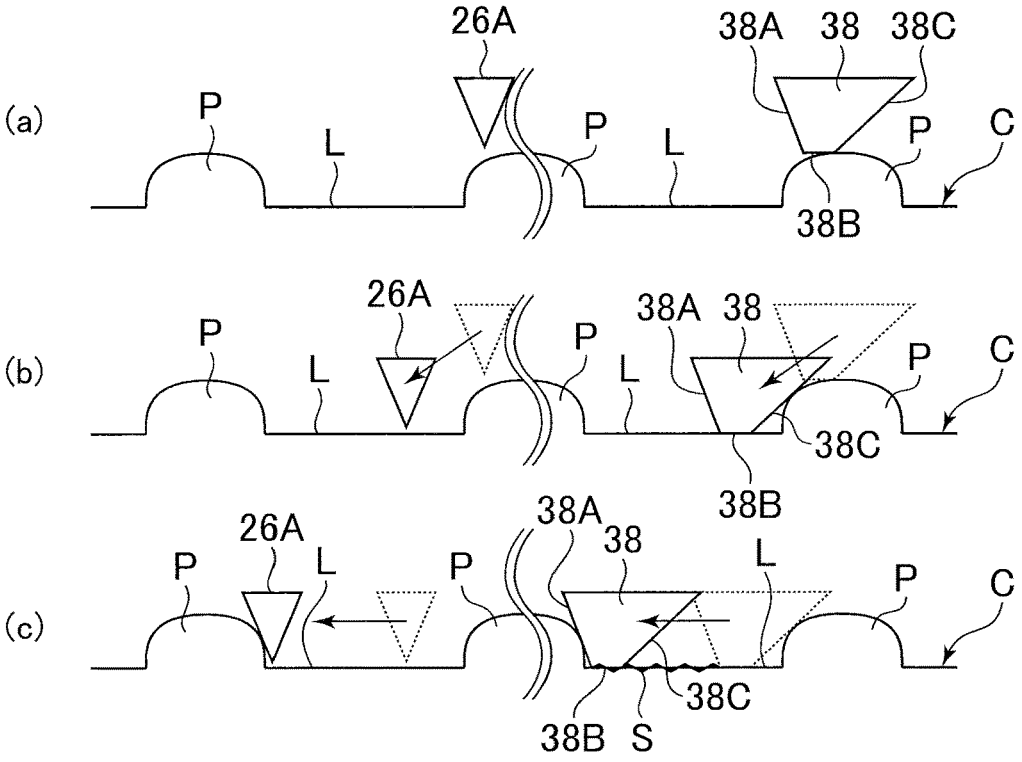
FIG. 10 schematically illustrates states of the movable chuck jaws and fixed chuck jaws of an alternate embodiment in time series.

FIG. 10, which corresponds to FIG. 8 and FIG. 9, illustrates configurations and the effect of movable chuck jaws of an alternate embodiment of the first embodiment. As illustrated in FIG. 10, a sectional form of the movable chuck jaw 38 of the alternate embodiment has a trapezoidal shape. Namely, the movable chuck jaw 38 includes a flat tip surface 33B between a leading flank 38A and a trailing flank 38B. Analogous to the first embodiment, the angle of a trailing flank 38C to the land portion "L" is less than the angle of a leading flank 38A to the land portion "L". The scratch marks "S" on the land portions "L" are generated by a corner or an edge defined by the leading flank 38A and the tip surface 38B. Accordingly, a starting point of the scratch mark "S" becomes more distant from the knurl "P", which is in contact with the trailing flank 38C, and penetration of the movable chuck jaw 38 into the land portion "L" is reduced. Thereby, the length and the size of the scratch marks are reduced in the alternate embodiment.

Figure 11:
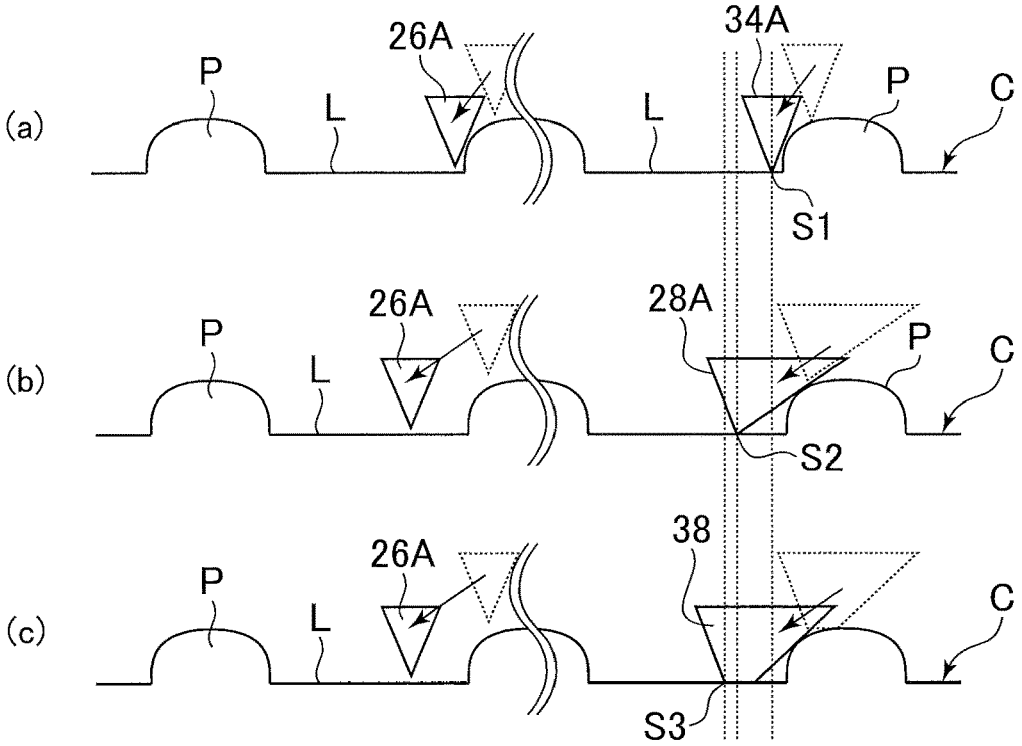
FIG. 11 illustrates a comparison between the starting points of the scratch marks produced in prior art, the first embodiment and the alternate embodiment.

FIG. 11 illustrates a comparison between the starting points of the scratch marks produced in prior art, the first embodiment and the alternate embodiment. FIG. 11 indicates starting points S1, S2 and S3 of the scratch marks caused by the movable chuck jaw 34A of the prior art, the movable chuck jaw 28A of the first embodiment, and the movable chuck jaw 38 of the alternate embodiment, respectively. In FIG. 11, the lengths of the scratch marks S1, S2 and S3 reduce in this order.

Figure 12:
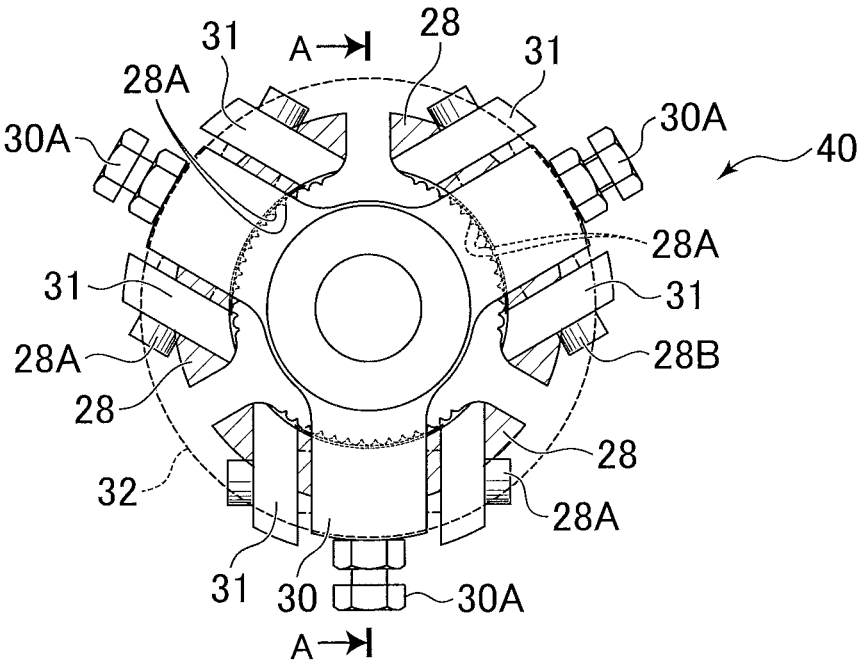
FIG. 12 is a top plan view illustrating an internal configuration of the chuck of the second embodiment.
Figure 13:
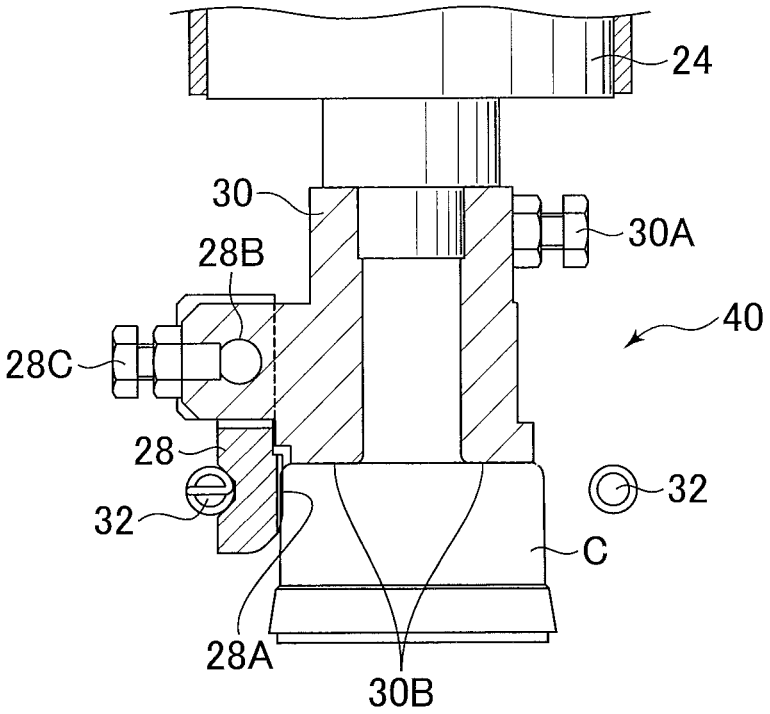
FIG. 13 is a cross sectional view of the chuck along Line A-A of FIG. 12.
Figure 14:
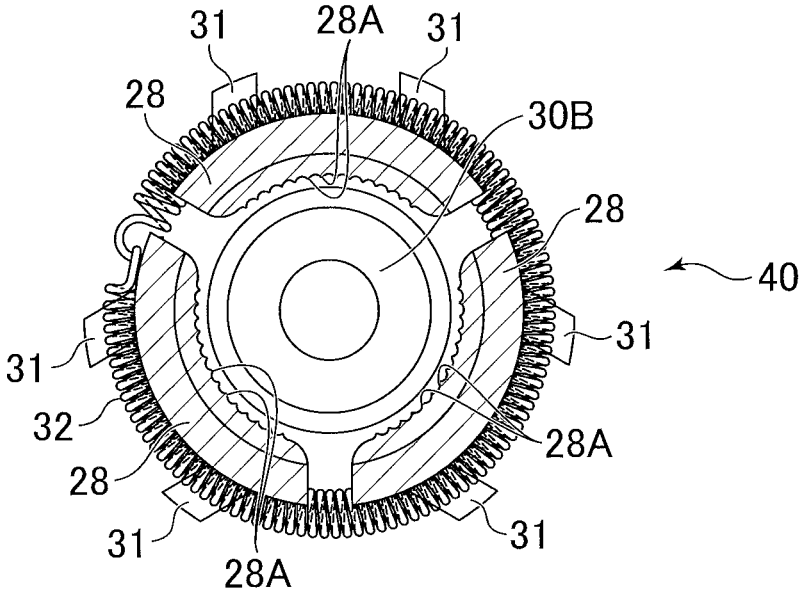
FIG. 14 is a bottom plan view illustrating an internal configuration of the chuck of the second embodiment.

With reference to FIGS. 12, 13 and 14, configurations of a chuck in a second embodiment will be explained. FIGS. 12, 13 and 14 each correspond to FIGS. 3, 4 and 5 of the first embodiment.

The chuck 22 of the first embodiment is configured from the fixed member 26 provided with fixed chuck jaws 26A and the chuck member 28 provided with movable chuck jaws 28A. However, a chuck 40 of the second embodiment is configured only from the chuck member 28 with the movable chuck jaws 28A. As illustrated in FIGS. 12 and 14, the chuck 40 of the second embodiment, for example, includes three chuck members 28 that are in an annular arrangement and being biased by the biasing member 32 radially inward over the circumference. Each of the chuck members 28 is rotatable about the pivot shaft 28A and holds the circumference of the cap "C" inserted inside the chuck 40 so that the movable chuck jaws 28A provided inside the chuck members 28 engages with the knurls "P" or the land portions "L" of the cap "C".

Although the basic configurations are the same as the first embodiment, the circumference length of the chuck member 28 of the second embodiment is longer than that of the first embodiment since the chuck 40 of the second embodiment has no fixed member 26.

Therefore, the chuck of the second embodiment produces the same effects as that of the first embodiment.

Although the embodiment of the present invention has been described herein with reference to the accompanying drawings, obviously many modifications and changes may be made by those skilled in this art without departing from the scope of the invention.

The invention claimed is:

1. A chuck for a capping machine, comprising:

a plurality of chuck members;

a biasing member configured to bias the plurality of chuck members radially inward;

a plurality of fixed members each of which is provided between the plurality of chuck members;

an abutting portion configured to abut against a top face of a cap which has knurls on an outer circumference of the cap;

a plurality of movable chuck jaws provided on an inner surface of each of the plurality of chuck members, each of the plurality of movable chuck jaws being defined by a leading flank and a trailing flank which are connected at each of tips of the plurality of movable chuck jaws, the trailing flank being provided behind the leading flank in a rotational direction of the chuck, the plurality of movable chuck jaws being provided between the knurls such that the tips of the plurality of movable chuck jaws are configured to stick into the outer circumference of the cap and such that the leading flank engages with a knurl among the knurls by rotating the chuck in the rotational direction;

an angle of the trailing flank with respect to the outer circumference of the cap being less than an angle of the leading flank with respect to the outer circumference of the cap; and a plurality of fixed chuck jaws provided on an inner surface of each of the plurality of fixed members, the plurality of fixed chuck jaws being provided between the knurls such that tips of the plurality of fixed chuck jaws do not contact the outer circumference of the cap and such that each of the plurality of fixed chuck jaws engages with a knurl among the knurls by rotating the chuck in the rotational direction.

* * * * *